US006409433B1

(12) United States Patent
Hubbell et al.

(10) Patent No.: US 6,409,433 B1
(45) Date of Patent: Jun. 25, 2002

(54) FOUNDATION PILES OR SIMILAR LOAD CARRYING ELEMENTS

(76) Inventors: David A. Hubbell, 112 Park Ave., Saranac Lake, NY (US) 12983; Alfred W. Owen, 5848 Sentinel Dr., Raleigh, NC (US) 27609

( * ) Notice: Subject to any disclaimer, the term of this patent is extended or adjusted under 35 U.S.C. 154(b) by 0 days.

(21) Appl. No.: 09/492,393

(22) Filed: Jan. 27, 2000

(51) Int. Cl.[7] ..... E02D 5/22; E04C 5/08; E04C 3/30

(52) U.S. Cl. ..... 405/250; 405/231; 52/223.4; 52/723.1; 52/736.3

(58) Field of Search ..... 405/252, 256, 405/257, 239, 232, 231, 250; 52/736.1, 736.3, 223.4, 721.2, 721.5, 223.8, 223.1, 721.4, 720.1, 726.3, 423, 723.1

(56) References Cited

U.S. PATENT DOCUMENTS 2,706,498 A * 4/1955 Upson ..... 405/256 X
3,145,540 A * 8/1964 Baittinger ..... 52/223.4 X
3,382,680 A * 5/1968 Takano ..... 405/256 X
3,501,920 A * 3/1970 Uchiyama ..... 52/223.4 X
4,166,347 A * 9/1979 Pohlman et al. ..... 52/223.4
4,312,162 A * 1/1982 Medney ..... 52/223.4 X
4,627,769 A * 12/1986 Lee ..... 405/256
5,056,284 A * 10/1991 Ruckdeschel et al. ..... 52/223.4
5,228,806 A * 7/1993 De Medieros et al. .. 405/256 X
5,320,453 A * 6/1994 Bullivant ..... 405/256 X
5,505,561 A * 4/1996 Willcox, III ..... 405/251
5,513,477 A * 5/1996 Farber ..... 52/726.4
5,788,419 A * 8/1998 Whitty, Jr. et al. ..... 405/256
5,870,877 A * 2/1999 Turner ..... 52/736.3
5,934,837 A * 8/1999 Lee ..... 405/250

* cited by examiner

*Primary Examiner*—Gary S. Hartmann
(74) *Attorney, Agent, or Firm*—I. Zborovsky

(57) ABSTRACT

A foundation pile, has at least one tensioning tendon which is elongated. A tubular wall forms a hollow conduit located around the at least one tendon so that a space remains between the tensioning tendon and the hollow conduit. A structural tubular element is located around the hollow conduit and composed of a non-metallic material. A tubular layer of a composite material is located around the structural tubular element and connected with the latter. A friction coating applied on an outer surface of the layer of composite material.

11 Claims, 1 Drawing Sheet

FOUNDATION PILES OR SIMILAR LOAD CARRYING ELEMENTS

BACKGROUND OF THE INVENTION

The present invention relates to foundation piles and similar load carrying structural elements.

A pile and/or load carrying similar structural element design advancing the present art is required to address all the following engineering characteristics:

a) Components that don't rust, corrode, or decompose when exposed to fresh water and/or sea water and/or sewage and/or water-borne creatures, plants, bugs or other things that like to eat, b) Does not require getting ready-mix concrete to the job-site, c) Ease of transport to job-site, d) Ease of handling and rigging, in marine and other similar applications, structural element sections, such as, but not limited to, piles, should float, e) Requires no new expensive handling and/or pile driving equipment, f) Quick field jointing of structural element sections, such as, but not limited to, piles, g) Structural element sections, such as, but not limited to, piles, design and construction by components certified and in use by state agencies and approved for use by Federal Agencies, h) Allows the use of existing engineering design codes, addresses pertinent engineering design consensus standards and specifications, i) provides a high "coefficient of skin-friction", j) the pile designer should be able to tailor the pile's "coefficient of skin-friction" to the expected soil matrix the pile is to be placed in, k) the structural element sections, such as, but not limited to, piles, should be fire resistant, through application of a "wearing surface"

l) the structural element sections, such as, but not limited to, piles, should resist impact damage, the pile design should allow for expected impact loads associated with transport, placement, installation and intended use, plus safety factor, through application of a "wearing surface".

m) the structural element sections, such as, but not limited to, piles, design should allow for inspection in-situ.

The present art of marine pile design has been limited to that constructed of steel, wood, or metal reinforcement concrete due to economic and engineering reasons. Maintenance costs due to corrosion of metal components and attack of boring marine animals on wood component have resulted in numerous attempts to address the shortcomings of the present art of marine pile design.

Grosse & Fehr U.S. Pat. No. 3,939,665 (Feb. 24, 1976) describe ". . . the application of a coating of a corrosion resistant covering consisting of an outer shield of stiff plastic . . . " protecting an existing, already-in-place, metal H-pile. The Grosse & Fehr U.S. Pat. No. 3,939,665 ". . . relates to the protection of metal piles from corrosion in underwater and semi-underwater environments." Grosse & Fehr U.S. 3,939,665 references Fox, U.S. Pat. No. 1,013,758 (Jan, 2, 1912), and Drusbel et al., U.S. Pat. No. 2,874,548 (Feb. 24, 1959), and Liddell, U.S. Pat. No. 3,321,924 (May 30, 1967) and finally Wiswell, U.S. Pat. No. 3,370,998 and states "(S)uch prior disclosures and practices, while effective to various extents to apply corrosion resisting coatings to piling in general, have not been notably successfully in applying corrosion resistant coatings to H or I-type metal piling or other irregularly shaped piling. It has in particular proven very difficult, and in many cases substantially impossible to obtain a good interfit which is effective to exclude moisture between the inside of the outer plastic coating and the outside of the H or I-pile due to the inconvenient shape of such piling." Grosse & Fehr U.S. Pat. No. 3,939,665 does describe why use of metal piling is not good design. Quoting from Grosse & Fehr U.S. Pat. No. 3,939,665, "Iron, as is well known, is not stable when subjected to the usual surface atmospheric conditions. Under such conditions, unprocted iron will oxidize to produce various oxides of iron which are more stable under surface conditions than the uncombined metal. Such oxidation or corrosioin, as is known, is accelerated beneath the surface of bodies of water, especially sea water. Corrosion of metal surfaces is particularly severe in the so-called 'splash zone.' The splash zone is the zone near the surface of the bodies of water, which is alternately exposed to water and air due both to changing level of tides and the like, the breaking of waves, the spray from waves and various other turblences coming in contact with metallic structures."

Grosse & Fehr U.S. Pat. No. 3,939,665 does not address, given all the problems associated, why H-piles or I-beam piles are used for piling. Grosse & Fehr U.S. Pat. No. 3,939,665, state that "(U)nfortunately H-beam and I-beam type piling, while strong and rigid for its weight, has large surface areas which, being made of metal, and usually iron, are subject to oxidation and other corrosive attack when exposed to corrosive environment." The reason why H and I-beam piles are frequently used, in spite of corrosion problems, si because of their ". . . large surface areas . . . " Piles are "driven" into a soil matrix. The act of "driving" the pile causes friction to develop between the soil matrix and the surface of the pile. This is commonly referred to as a pile's skin-fraction. Pile skin-friction frequently accounts for most or all the physical support the soil-matrix provides. In piling applications where skin-friction is the dominate support mechanism, the "surface area-to-cross-sectional area ratio" becomes an important economic issue for a number of reasons. Some of those reasons, but not limited to, are A) transport costs of the pile sections to the installation site. This is a function of how much "surface-area" can be transported at a time. That is, in the case where friction is an important design factor, the more friction developed per length of structural element the lower the overall cost of transportation, and obviously other associated costs, will be. As such, a "round" cross-section is less efficient than a "square" which is less efficient than a "triangle" and so on. The more efficient shape for the present invention, in specific applications, would be as a "corrugated" "sheet" pile. B) pile driving operations are functions of how long it takes for the pile being "pushed" into the soil-matrix to develop the amount of friction to resist the design-loads demanded. The greater the "surface area-to-cross-sectional area ratio" the shorter the required length of pile that needs to be placed into the soil-matrix for the required development of friction. C) in extremely "weak" soil-matrix conditions, the "dead-load" weight of the pile itself, as a ratio to the unit length of surface area, becomes a design factor. That is, pile-foundations must be designed to carry all design loads including the weight of the pile itself. Increasing the total surface-area available for friction load between pile and soil-matrix while reducing the weight of the pile in question allows for a more overall economic use of materials for the structure intended to be supported by the pile-foundation in question. D) freuqently, a site's macro-soil-matrix includes layers of "strong-soils" interlaced with layers of "weak-soils". Shorter piles which allow full development of design loads without penetrating deeper "weak-soil" layers which could lead to foundation instability after installation of a pile foundation. For example, if a pile foundation is driven thru a "weak-soil" strata or a series of "weak-soil" strata resulting in a "puncture" of a previously water-tight strata, the result may be a "de-watering" of the strata in question which could result in a reducing of load-bearing capacity of said strata. Grosse & Fehr U.S. Pat. No. 3,939,665 would have the pile installer use ". . . a heavy grease or other petroleum products, applied to the inner surface . . . " to a pile in -situ. While the state of the art at the time of the Grosse & Fehr U.S. Pat. No. 3,939,665 patent. 1976, may have allowed this practice, present U.S. Environmental Protection Agency regulations make use of such practices more expensive today.

Fox 4,019,301 (Oct. 24,1977) describes "(A) protective system for concrete, wood and steel piling or other structures subject to corrosion or wear from the action of water. This system includes an encasement sleeve . . . and a filler . . . between the encasement sleeve and the piling." "The encasement and filler are left permanently on the structure to protect the same from water or other elements, and also to reconstruct worn portions to achieve the original structural integrity of the structures." Fox U.S. Pat. No 4,019,301 is a retro-fit invention. It is intended for repair of in-situ piles. Quoting from Fox U.S. Pat. No. 4,019,301, ". . . and inert sleeve of fiberglass, epoxy, or similar material is formed to fit around the piling and is positioned about the piling at and below the water level. In the space between the encasement sleeve and the piling a filler of epoxy grout or the like is deposited and allowed to set to complete the protective covering for the piling without the need for dewatering procedures." As mentioned above, While the state of the art at the time of Fox may have allowed this practice, present U.S. Environmental Protection Agency regulations make use of such practices more expensive today, if in fact legal under present EPA requirements. In addition to potential environmental aspects of the Fox U.S. Pat. No. 4,019,301 invention, the nature of Fox U.S. Pat. No. 4,019,301 may case structural problems. Application—of the Fox U.S. Pat. No. 4,019,301 encasement or the Colbert et al U.S. Pat. No. 4,023,374 (May 17, 1977) "sleeve" or the Moore U.S. Pat. No. 4,306,821 (Dec. 22, 1981) "outer circumferential form" or the Fawley U.S. Pat. No. 5,633,057 (May 27, 1997) "composite reinforcing sleeves" or Neuner et al. U.S. Pat. No. 5,925,579 (Jul. 2, 1999)—may result in unintended structural loading of the structural element in question. All of the aforementioned inventions add to the diameter of the original structural member. In doing so, the originally intended section-modulus is replaced with a greater section-modulus. In addition, the use of the materials cited in the aforementioned inventions could significantly increase both the structural member's load carrying capacity but also significantly increase said structural member's deflection characteristics when under load. By itself, this increase in "stiffness" may not be important in isolation unto said structural member. However, the mentioned structural member is usually a single component of a larger, more complex, structural system. That is, in the case of a wharf, the structural member being only one pile of a number used to support the wharf deck, any increase in stiffness of a single pile will cause loadings to transfer from the less stiff piles to the single stiffer pile. The concentration of load forces can result in significant unintended structural loadings elsewhere in the wharf's structural system.

Quoting from Fox U.S. Pat. No. 4,019,301 "it is well known that conventional piles, made of concrete wood or steel, will deteriorate rapidly at the water line, even when reinforced by the use of a combination of these materials." Mirmiran et al. U.S. Pat. No. 5,599,599 (Feb. 4, 1997) addresses problems identified by Fox U.S. Pat. No. 4,019,301, as "(T)he invention has the effect of waterproofing and insulating the exposed concrete columns and piles of infrastructure supports and protecting any steel/metal reinforcing bars and cages in the cement cores from the effects of corrosion." Mirmiran U.S. Pat. No. 5,599,599, by encasing; making waterproof, and use of a highly heat insulating material such as FRP, does not address such problems. Mirmiran U.S. Pat. No. 5,599,599 use of FRP pultruted components for shear transfer between the FRP exterior shell and concrete core is questionable due to the smooth surface natural to FRP pulrutions. Finally, Mirmiran U.S. Pat. No. 5,599,599 offered no bonding between the exterior FRP shell and concrete core. Given concrete's nature to shrink as it ages, any initial shear transferring bond between the FRP shell and concrete core could degrade over time. As noted by Fawley U.S. Pat. No. 5,633,057, ". . . concrete slurry . . . shrinkage . . . and therefore, there is inadequate load transfer . . . " i.e. shear.

In each of Mirmiran U.S. Pat. No. 5,599,599 offered embodiments FIG. 1A, FIG. 1B, FIG. 1C, FIG. 1D, FIG. 2A, FIG. 2B, FIG. 3A, FIG. 3B, FIG. 4A and FIG. 4B, quoting from Mirmiran U.S. Pat. No. 5,599,599 "The invention consists of hollow FRP shell filled with concrete." While Mirmiran U.S. Pat No. 5,599,599 suggests that ". . . the invention can be used as concrete piles . . . ", the invention does not address how the FRP shell will encourage skin-friction, nor how in the act of placing the invention into a soil-matrix that it would keep its "waterproofing". For use as an above ground structural member Mirmiran U.S. Pat. No. 5,599,599 fails to address how to keep fire and/or insulating the exterior shell from damage, both of which directly threaten any Mirmiran U.S. Pat. No. 5,599,599 structure's structural integrity.

March et al. U.S. Pat. No. 5,658,519 (Aug. 19, 1997) does not address threats of fire, nor skin friction issues, nor economic costs associated with use of plastics. March U.S. Pat. No. 5,658,519 does not address the lack of "stiffness" in handling and driving such as pile. March U.S. Pat. No. 5,658,519 offers no means or methods for field attaching individual sections of pile.

Isley, Jr. U.S. Pat. No. 5,218,810 (Jun. 15, 1993) addresses retro-fitting existing reinforced concrete columns with a composite reinforcement layer on the exterior surface to provide "hoop" strength said column. Isley, Jr. U.S. Pat. No. 5,218,810 requires the composite material to remain of a consistent nature as it is "wrapped" around the reinforced concrete column. The present invention's ability to strategically place composite material(s) on the structural element's core allows for applications other than columns such as, but not limited to, structural beams. In the specific case of marine foundation piles, the present art of handling piles on job-site requires such piles to act as "beams". Isley, Jr. U.S. Pat. No. 5,218,810 only addresses retro-fit applications, not pre-assemble and/or precast and/or off-site manufacturing/fabrication of complete structural elements and thus Isley, Jr. U.S. Pat. No. 5,218,810 does not address problems in the present art of handling pre-assembled and precast structural elements.

It is believed to be advisable to further improve the foundation piles and similar load carrying elements.

SUMMARY OF THE INVENTION

Accordingly, it is an object of the present invention to provide a foundation pile which avoids the disadvantages of the prior art.

In keeping with these objects and with others which will become apparent hereinafter, one feature of present invention resides, briefly stated, in a foundation pile which comprises at least one tensioning tendon which is elongated in a direction of elongation, means forming a hollow conduit located around the at least one tendon so that a space remains between the tensioning tendon and the hollow conduit, a structural tubular element located around the hollow conduit and composed of a non-metallic material, a tubular layer of a composite material located around the structural tubular element and connected with the later, and a friction coating applied on an outer surface of the layer of composite material.

When the foundation pile is designed in accordance with the present invention, it does not attempt to apply an outer corrosion resistant coating for the purpose of connecting metal pipes as in the patent to Grosse, and it does not deal with skin-friction problems as in this patent. It avoids the use of metals where corrosion is undesirable and provides a significant wearing surface which negates many of the problems disclosed in the patents to Fox, Moore, Fawle and Neuner. It does not insulate its concrete when concrete is used based on recognition that concrete when allowed to remain moist continues to gain overall strength. It eliminates threats of fire and impact damage in contrast to the patent to Mirmiran, it allows placing individual strips of composite material of different material contents and uses unreinforced concrete core in contrast to the patent to Isley.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 2:
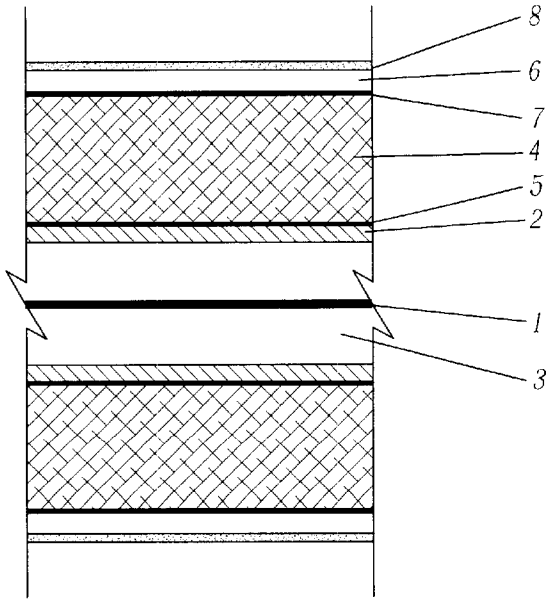
FIG. 2 is a view showing a transverse section of the inventive foundation pile.
Figure 1:
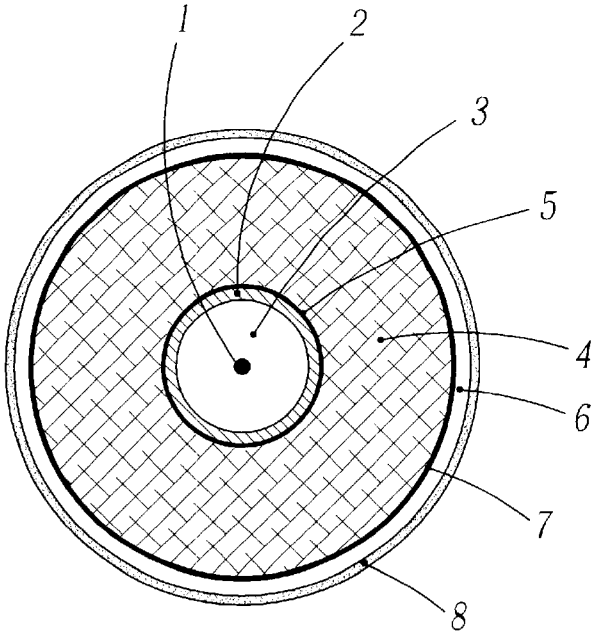
FIG. 1 is a view showing a longitudinal section of a foundation pile in accordance with the present invention.

A foundation pile in accordance with the present invention can be formed for example as marine foundation pile or any other load-carrying supporting element for other applications as well.

The inventive foundation pile has one or more tensioning tendons. Only one tendon which is identified as a whole with reference numeral 1 is shown in the drawings. However more than one can be provided in the inventive pile. The tendon or tendons are post-tensioned after the pile is produced, in a manner which is known per se.

The foundation pile of the invention further has a structure which forms a hollow conduit. The structure shown in the drawings as an exemplary embodiment is formed as a tubular wall which can be composed, for example plastic, and identified with reference numeral 2. The tubular wall has such an inner diameter that an inner hollow space remains between the inner surface of the tubular wall of the conduit and the tendon or tendons, as identified with reference numeral 3.

The hollow conduit is surrounded by a structural tubular element 4. The structural tubular element 4 can be composed of various materials, which however are non-metallic. Such materials can be for example concrete, plastic, rubber, structural foam, etc. A friction coating can be applied on the tubular wall of the hollow conduit to provide an improved connection between the wall of the hollow conduit and the structural tubular element. The friction coating can be composed for example of sand distributed in a binder, for example a resin, such as an epoxy resin as identified with reference numeral 5. However the friction coating is not absolutely necessary.

A next component of the inventive foundation pile is a composite material which is applied as an outer layer around the structural tubular element. The layer of composite material is identified with reference numeral 6. The composite material layer 6 can be composed of fiberglass or carbon fibers and/or similar materials. It can be formed as a single shell or can be composed of a plurality of thin layers. It can also include metal components intended to oxidize at a placement of the pile in a medium. The composite material can be formed of individual strips of different material contents. The structural tubular element can be connected with the layer of composite material by an intermediate connecting layer. The intermediate connecting layer which is identified with reference numeral 7 can be composed of resin, for example epoxy resin and the like.

The outermost component of the inventive foundation pile is a friction coating which is identified with reference numeral 8. The friction coating can be formed as a layer which contains a plurality of friction-imparting particles in a binder. The binder can be a resin, for example again an epoxy resin, and the particles are selected to correspond to a medium in which the pile will be driven. For example for fine aggregate soils such as sand soils, the friction component of the filler of the friction coating can be sand. For high organic soils such as bog which are weak soils, the filler in the friction coating can be crushed rocks.

The manufacturing process includes the following:

i) friction coating is, but not always required, applied to the hollow conduit, ii) forming the concrete, and/or plastic and/or rubber and/or structural foam around the hollow conduit(s), iii) placing the tensioning tendon in the hollow conduit, iv) tensioning the tension tendon v) forming and attaching the composite material shell or layers to the surface of the concrete, and/or plastic and/or rubber and/or structural foam component, vi) selection and attaching the friction coating material to the composite material shell or layers.

vii) Alternatively adding an internal friction coating to a composite shell and filing shell with a core material.

Addressing the "driving-the-pile" issue, as piles are driven by vibrating or pounding on the top of the pile section being driven, the force of the driving load must be transmitted to the pile tip and pile skin that is in contact with the soil layers that are resisting the "driving" force. As the barrel of the pile need not be designed to have the capacity to resist the impact of the pile drive hammer, the end of the pile exposed to the pile drive hammer must be reinforced to handle impact and to transmit the driving load uniformly to the pile's barrel section.

Addressing the jointing of pile section together-given the usual length restrictions of a standard tractor-trailer of 40 to 45 feet—there is usually an installation requirement to attach or joint multiple pile sections. That is, when the first section is driven into the soil-matrix, the piling driving operation must attach the next pile section. Economic reasons require a quick jointing procedure.

Placement of strain-gages on the post-tensioning strands, after post tensioning via sealable, and/or resealable portals into the structure's post-tensioning conduit, allows for monitoring of structural integrity during manufacturing, transport, installation activities and after installation for monitoring of load displacements before, during and after placement of superstructure on the installed pile foundation.

The present invention's ability to strategically place composite material(s) on the structural element's core allows for application other than providing "hoop" strengthening of core compressive materials. This allows for, but not limited to, structural beams. In the specific case of marine foundation piles, handling piles, on job-site requires such piles to be designed to also act as "beams".

The following is an offered example of how through the use of the present invention as a marine pile could be designed to answer the following engineering characteristics required:

a) Components that don't rust, corrode, or decompose when exposed to fresh water and/or sea water and/or sewage and/or water-borne creatures, plants, bugs or other things that like to eat, b) Does not require getting ready-mix concrete to the job-site, c) Ease of transport to job-site, d) Ease of handling and rigging, in marine and other similar applications, structural element sections, such as, but not limited to piles, should float, e) Requires no new expensive handling and/or pile driving equipment, f) Quick field jointing of structural element sections, such as, but not limited to, piles, g) Structural element sections, such as but not limited to, piles, design and construction by components certified and in use by State Agencies and approved for use by Federal Agencies, h) Allows the use of existing engineering design codes, addresses pertinent engineering design consensus standards and specifications, i) provides a high "coefficient of skin-friction", j) the pile designer should be able to tailor the pile's "coefficient of skin-friction" to the expected soil matrix the pile is to be placed in, k) the structural element sections, such as, but not limited to, piles, should be fire resistant, through application of a "wearing surface".

l) the structural element sections, such as, but not limited to, piles, should resist impact damage, the pile design should allow for expected impact loads associated with transport, placement, installation and intended use, plus safety factor, through application of a "wearing surface".

m) the structural element sections, such as, but not limited to, piles, design should allow for inspection in-situ.

As mentioned in a) above, an appropriate marine pile design should address the expected environment the in-situ pile location. As such, selection of individual components should include only those which don't rust, corrode, decompose or are edible. The designer may in fact desire individual component corrosion for specific applications which are discussed later. The present invention utilize plastics, fiberglass, carbon-fibre, rubbers, epoxies, concrete and metal components acceptable for the environment in question.

Addressing b), the present invention is designed as a pre-assembled pile. When concrete is used, the concrete components are "precast" so that ready-mix concrete is not required to be used for the piling on the job-site.

Addressing c) above, the ease of transport to the job-site is a critical factor in the economic aspects of the present invention. Restraints imposed by job-site access, and the piling driving equipment limitations should dictate the length of individual piling sections. The present invention addresses this by design. Lengths of individual sections are limited only by the method and means of the type of transport allowing access to the job-site.

Addressing d) above, the issues of ease of handling and rigging, in marine and other applications, pile sections should float. The present design allows for the introduction of specific handling and/or rigging structural "hard-points" on the pile "barrel" and/or pile section "end(s)". Regardless of the composition of individual pile sections, through the use of the present invention, the pile design can be accommodated to insure that individual pile sections "float" by adjusting the diameter(s), and thus the volume(s), of the tension-tendon(s) hollow conduct(s). Loss of pile section "over-the-side" in marine applications can be physically dangerous and economically costly. Addressing the flotation issue is an important aspect of the present invention. Another aspect of providing for design of overall weight per given volume allows for reduction of overall transportation costs by maximizing the weight/volume restrictions of the transport method dictated by the pile user.

Addressing e) above, the present invention requires no new expensive pile driving equipment. The present invention uses existing pile driving equipment.

Addressing f) above, the present invention allows for quick field jointing of one pile section to the next. Through the use of existing in use, Federal and State Transportation Agencies' approved methods of jointing precast concrete structural components, the present invention provides for jointing pile sections as fast or faster than the current art and/or less costly than the current art.

Addressing g) above, the present invention pile's design and construction is a new means and method of configuring components certified and in use by State Agencies and approved for use by Federal Agencies. Use of pre-certified components allows quicker acceptance on the present invention by the Engineering community.

Addressing h) above, supported by g) the present invention allows the use of existing engineering design codes, addresses pertinent engineering design consensus standards and specifications.

Addressing i) above, the present invention provides a high "coefficient of skin-friction", loadings that exceed the pile's design-load requirements. The cost of pile foundations is usually a direct function of the friction developed between the "skin" of the pile and the soil-matrix in question and the total area of pile-to-soil-matrix interface. Skin-friction coupled with interface area defines how costly most marine pile foundations will be as the number of piles and the length to which individual piles must be driven is a direct function of these two. The present invention addresses the issue of total area of pile to soil-matrix interface by providing for a flexible design approach to individual pile sections' cross-sectional shape.

Addressing j) above, the present invention gives design flexibility to the pile designer to tailor the pile's "co-efficient of skin-matrix" to the expected soil matrix the pile is to be placed in. As stated, pile design is frequently an issue of pile skin-fraction and total area of interface between pile and soil. Foundation engineers usually have access to soil borings. As such, tailoring the pile surface coatings for maximizing the coefficient of friction, by way of sizing and mix of ground and/or crushed rock, such as but not limited to flint, and/or sand and epoxy and/or resin mixture to the expected soil matrix composition result in minimizing the number of piles and/or depth to which the piles must be driven which directly affects individual pile costs and total foundation costs.

Addressing k) above, the present invention addresses the need for the pile to be fire resistant. The current art offers numerous means and methods for using outer shells consisting of materials such as fiberglass and carbon-fibre cloth, these composite materials tend to rapidly lose strength when exposed to high heat and/or fire. The current art also stresses completely wrapping and sealing the core material, which is usually concrete. The current art in fact stresses the outer shell's insulating and waterproofing effects. The present invention does not require the use an "insulating", "waterproofing", enclosing shell of composite materials. In applications such as, but not limited to, pile top sections which may be exposed to potential fire conditions, the present invention allows for designs whereby the composite material is attached in "strips", which may be oriented longitudinally and/or circumferentially and/or diagonally to the "barrel" of the pile. The pattern, where fire is a concern should have gaps or holes leaving the "core" material exposed to the outer "friction" coat. In the case of the use of concrete as a "core" material, especially when used as a marine pile, migration of water into the concrete is beneficial. Concrete, in particular precast concrete, if allowed to remain moist after curing, actually gains structural strength. The benefit of an "open" pattern, in the case of fire, allows the considerable "heat-sink" of the "core", in the case of concrete, to wick-away heat from the composite-material-shell allowing a longer grace-period before a loss of structural strength of the composite-material-shell. The outer "friction" coat acts as a natural insulator providing protection to the heat-sensitive compososite-materials-shell.

Addressing 1) above, the same aforementioned outer "friction" coat allows for expected impact loads associated with transport, placement, installation and intended use. The current art does not address the vulgarities of handling operations usually associated with construction sites, and potential damage which could occur if the composite-material-shell is banged, bumped or otherwise injured during any phase until it is in its intended place. While there are a couple of marine pile designs utilizing fiberglass, or the like, available they all suffer from a number of shortcomings. First, most do not address "skin-friction". This is a significant oversight affecting both engineering and economic considerations. A marine pile "coefficient of skin-friction" is analogous to grades of sand-paper. Usually, the "rougher" or "courser" the skin, the higher the "coefficient of skin-friction". The word "usually" is used because the soil matrix that the pile is to be placed (pounded-into) is the partner to the pile's skin which produces the "friction". As such, offering the pile designer the ability to tailor the pile's skin's profile to the soil matrix in question will allow for a shorter length of pile given a specific soil-matrix. This results in fewer linear feet of pile to buy and fewer linear feet to drive, i.e. a more economic pile design. Application of a "friction-coat" consisting of select gradations of sand and/or select gradations of crashed rock and/or other abrasive materials provides both a tailored "coefficient of skin-friction" for the soil-matrix in question and fire and/or potential impact damage insulation of the composite tensile coating.

Addressing m) above, the nature of traditional foundation design limits inspection of the foundation piles once in-place. The present invention provides for the pile design for inspection in-situ by way of the tension-tendon void. Providing that a sealed passage-way is installed, at the time of the pile placement, from one pile section's void(s) to the next pile section's void(s), then standard structural inspection camera equipment can be lowered and/or "snaked" through the entire pile. This same access to the length of the pile can also be used to supply air and/or oxygen to oxidize metal-components which could be intentionally placed between the composite-materials-shell and the outer "friction" coat. Oxidation would cause the metal-oxide to "expand" pushing the "friction" coat components into, and thus increasing friction resistance, the surrounding soil-matrix. The hollow conduit, if used, also allows for placement of equipment which could provide information as to the actual location of individual pile sections in the soil-matrix.

It will be understood that each of the elements described above, or two or more together, may also find a useful application in other types of constructions differing from the types described above.

While the invention has been illustrated and described as embodied in foundation pile or similar load carrying elements, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A foundation pile, comprising at least one elongated tensioning tendon which is elongated in a direction of elongation; means forming a hollow conduit located around said at least one tendon so that a space remains between said tensioning tendon and said hollow conduit; a structural tubular element located around said hollow conduit and composed of a non-metallic material; a tubular layer of a composite material located around said structural tubular element and connected with the later; and a friction coating applied on an outer surface of said layer of composite material.

2. A foundation pile as defined in claim 1, wherein said structural tubular element is composed of a material selected from the group consisting of concrete, plastic, rubber and structural foam.

3. A foundation pile as defined in claim 1, wherein said layer of composite material is composed of a material selected from the group consisting of fiberglass and carbon fiber.

4. A foundation pile as defined in claim 1, wherein said layer of composite material is formed as a shell.

5. A foundation pile as defined in claim 1, wherein said layer of composite material is composed of a plurality of individual layers.

6. A foundation pile as defined in claim 1, wherein said layer of composite material includes metal components intended for oxidation after placement of a pile in a medium.

7. A foundation pile as defined in claim 1; and further comprising a friction layer located between said hollow conduit and said structural tubular element.

8. A foundation pile as defined in claim 1; and further comprising a layer of a connecting material provided between said structural tubular element and said layer of a composite material.

9. A foundation pile as defined in claim 8, wherein said connecting layer is composed of resin.

10. A foundation pile as defined in claim 1; and further comprising a connecting layer provided between said layer of composite material and said friction coating.

11. A foundation pile as defined in claim 10, wherein said connecting layer is composed of resin.

* * * * *